US007317373B2

(12) United States Patent
Hsu et al.

(10) Patent No.: US 7,317,373 B2
(45) Date of Patent: Jan. 8, 2008

(54) INDUCTOR

(75) Inventors: Han-Cheng Hsu, Taoyuan Hsien (TW); Chih-Tse Chen, Taoyuan Hsien (TW); Ching-Man Kao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 83 days.

(21) Appl. No.: 11/206,239

(22) Filed: Aug. 18, 2005

(65) Prior Publication Data

US 2007/0040639 A1 Feb. 22, 2007

(51) Int. Cl.
*H01F 5/00* (2006.01)

(52) U.S. Cl. ..... 336/200; 336/223; 336/232

(58) Field of Classification Search ..... 336/200, 336/232, 223

See application file for complete search history.

(56) References Cited

U.S. PATENT DOCUMENTS 6,882,261 B2 * 4/2005 Moro et al. ..... 336/200

FOREIGN PATENT DOCUMENTS

| | | |
|---|---|---|
| CN | 1372272 | 10/2002 |
| JP | 9-35951 A | 2/1997 |
| JP | 2002-324714 A | 11/2002 |

* cited by examiner

*Primary Examiner*—Anh Mai
(74) *Attorney, Agent, or Firm*—Birch, Stewart, Kolasch & Birch, LLP

(57) ABSTRACT

An inductor is made of a flat conducting wire with a constant thickness. The inductor includes a coiled portion and two leg portions. The leg portions are end parts of the flat conducting wire that are processed with a specific process. In addition, each leg portion has a thickness smaller than that of the coiled portion.

17 Claims, 4 Drawing Sheets

INDUCTOR

BACKGROUND OF THE INVENTION

1. Field of Invention

The invention relates to an inductor and, in particular, to an inductor used for a power supply.

2. Related Art

With reference to FIGS. 1A and 1B, a conventional inductor component used for a power supply is composed of inductors 10 and 20, bases 12 and 22, and covers 11 and 21. Each of the inductors 10 and 20 is usually made of a coiled flat conducting wire and includes a coiled portion and two end portions.

The suitable thickness of the flat conducting wire for manufacturing the inductor 10 or 20 and the selected coiling number are various depending on the real current loading in practice. In general, the flat conducting wire for manufacturing the inductor of the high current loading has the greater thickness and more coiling number.

As mentioned above, regarding to the high current environment, the thickness of the flat conducting wire must be great. Thus, the end portions of the flat conducting wire may not be bended easily, resulting in the difficult for connecting the end portions with other components. The above-mentioned drawbacks are harmful to the assembling between the inductor and other components.

Therefore, it is an important subject of the invention to provide an inductor that can solve the assembling problem caused by the great thickness of the conventional inductor.

SUMMARY OF THE INVENTION

In view of the foregoing, the invention is to provide an inductor that can be assembled with other components without restricted by the thickness of the conducting wire.

In one aspect, an inductor made of a coiled flat conducting wire with a constant thickness includes an induction portion and two leg portions. The induction portion is a coiled part of the flat conducting wire. The leg portions are two end parts of the flat conducting wire. In the invention, the end parts of the flat conducting wire are processed with a specific process, so that each leg portion has a thickness smaller than the thickness of the flat conducting wire.

In another aspect, an inductor comprises a coiled portion having a first thickness and at least one leg portion. The coiled portion has a first thickness. The leg portion extends out from the coiled portion and has a second thickness different from the first thickness.

In one embodiment, the specific process is a cutting process or a pressing process, each leg portion has a thickness between 0.01 mm and 0.40 mm, and the extension directions of the leg portions are in parallel or perpendicular to each another.

In another embodiment, the specific process is a cutting process, and the thickness of each leg portion is decreased gradually from the joint of the leg portion and the induction portion to the end of the leg portion.

In still another embodiment, each leg portion has a plurality of protrusions formed by the specific process, and the protrusions can be engaged with concave portions of other components so as to complete the assembling.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
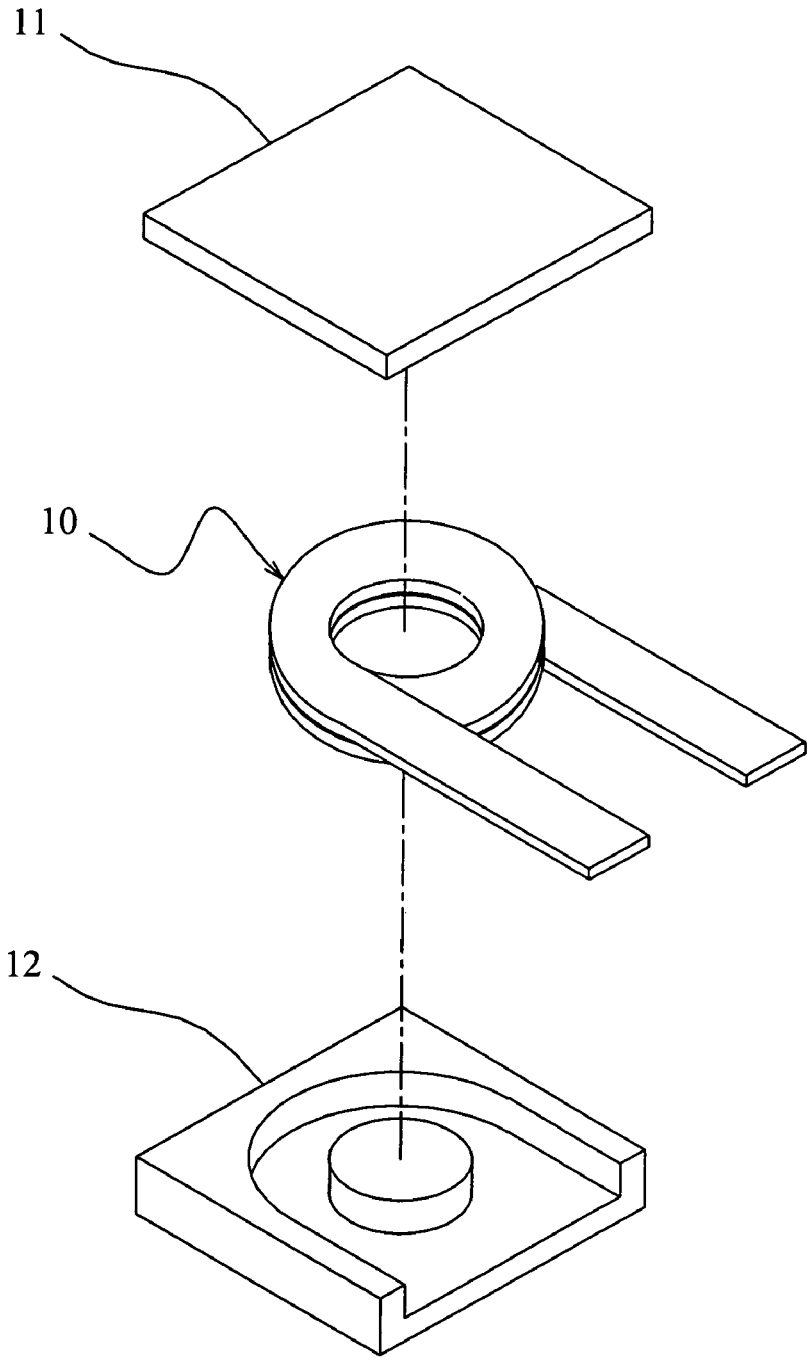
PRIOR ART FIG. 1A
FIG. 1A is a schematic view showing the conventional inductor component.
Figure 1B:
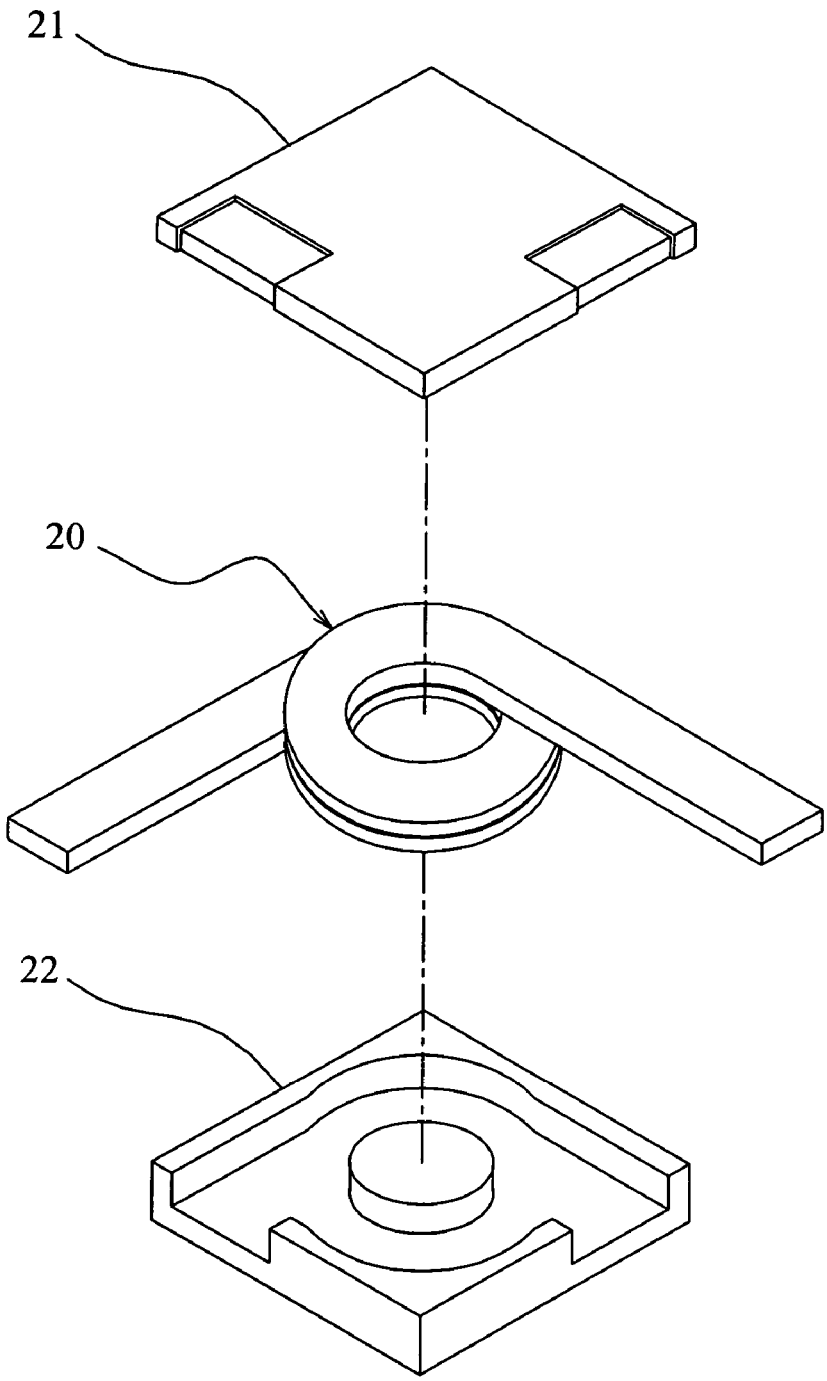
PRIOR ART FIG. 1B
FIG. 1B is a schematic view showing another conventional inductor component.
Figure 2A:
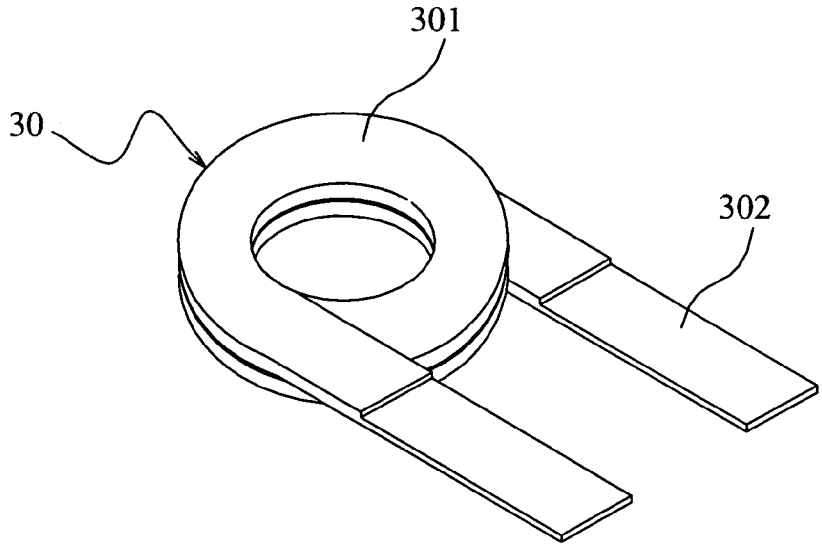
FIG. 2A is a schematic view showing an inductor according to a preferred embodiment of the invention.
Figure 2B:
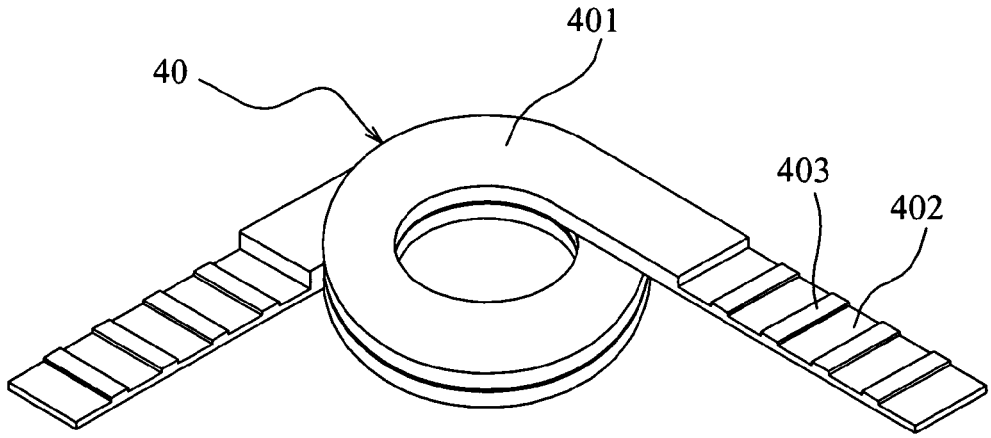
FIG. 2B is a schematic view showing another inductor according to the preferred embodiment of the invention.

With reference to FIGS. 2A and 2B, an inductor 30/40 according to a preferred embodiment of the invention is made of a coiled conducting wire with a constant thickness, and includes an induction portion 301/401 and two leg portions 302/402. The thicknesses of the leg portions 302/402 and the induction portion 301/401 are difference. The conducting wire is a flat conducting wire. In this embodiment, the induction portion 301/401 is the coiled part of the flat conducting wire, and the leg portions 302/402 are the end parts of the flat conducting wire. Herein, the end parts of the flat conducting wire are processed with a specific process, so that each leg portion 302/402 has a thickness smaller than that of the flat conducting wire. In this case, the specific process is a cutting process, and the thickness of each leg portion 302/402 is, for example, ranging from 0.01 mm to 0.40 mm and is preferably about 0.24 mm.

Figure 3A:
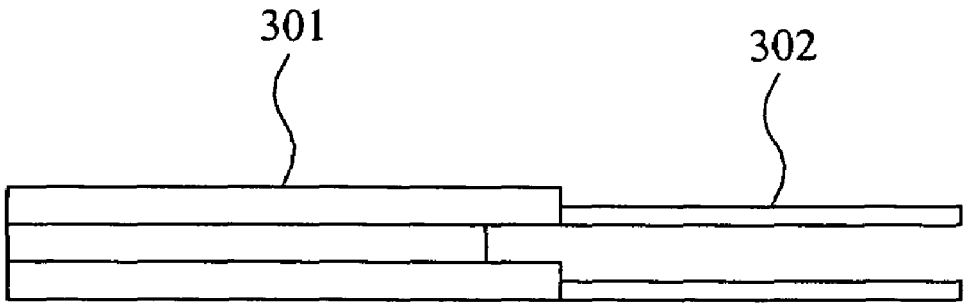
FIG. 3A is a side view showing an inductor according to the preferred embodiment of the invention.
Figure 3B:
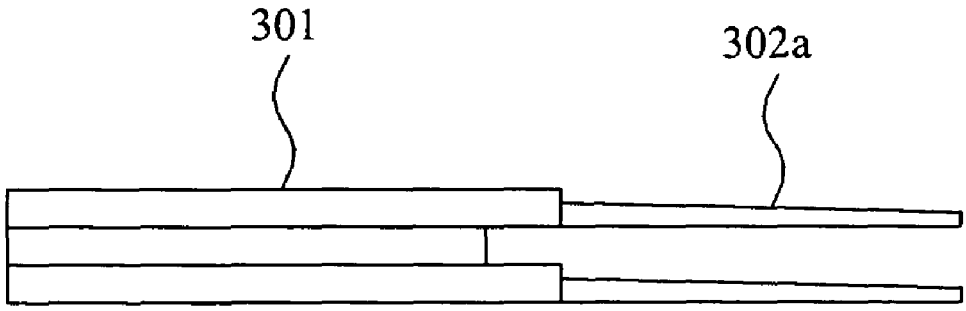
FIG. 3B is a side view showing another inductor according to the preferred embodiment of the invention.

Taking a side view of the inductor as shown in FIG. 3A, the thickness of each leg portion 302 is constant. Alternatively, as shown in FIG. 3B, the thickness of each leg portion 302*a* is decreased gradually from the joint of the leg portion 302*a* and the induction portion 301 to the end of the leg portion 302*a*.

As mentioned above, the leg portions 302/402 is flexible and can be bended easily. Besides, the leg portions 302/402 can be coated with solder, such as tin solder, for directly connecting with other components. Accordingly, the cost for the additional solder pad can be saved.

In addition, the inductor 30 and the inductor 40 are different in the extension directions of the leg portions and the protrusions 403 disposed on the leg portions 402. In more details, the extension directions of the leg portions can be in parallel such as the configuration of the leg portions 302 of the inductor 30. Alternatively, the extension directions of the leg portions can be perpendicular to each other such as the configuration of the leg portions 402 of the inductor 40. Moreover, the leg portion may have a plurality of protrusions or corresponding concaves formed by the specific process. For example, the leg portions 402 have a plurality of protrusions 403 for engaging with concave portions or protruding portions of other components so as to complete the assembling. Furthermore, the protrusions 403 can enhance the adhesion of the solder. In the current embodiment, any two adjacent protrusions 403 have the same interval.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An inductor having a flat conducting wire with a constant thickness, comprising:

a coiled portion; and two leg portions, which are end parts of the flat conducting wire, wherein the end parts of the flat conducting wire are processed with a specific process so that each of the leg portions has a thickness smaller than that of the coiled portion, and the thickness of each of the leg portions is decreased gradually from the joint of the leg portion and the coiled portion to the end of the leg portion.

2. The inductor of claim 1, wherein the specific process is a cutting process or a pressing process.

3. The inductor of claim 1, wherein each of the leg portions has a thickness ranging from 0.01 mm to 0.40 mm.

4. The inductor of claim 1, wherein the leg portions are flexible or coated with solder.

5. The inductor of claim 1, wherein the extension directions of the leg portions are in parallel or perpendicular to each another.

6. An inductor comprising:

a coiled portion; and two leg portions extending out from the coiled portion, wherein each of the leg portions has a plurality of protrusions formed by a specific process.

7. The inductor of claim 6, wherein any two adjacent protrusions have the same interval.

8. An inductor comprising:

a coiled portion having a first thickness; and at least one leg portion extending out from the coiled portion and having a second thickness different from the first thickness, wherein the second thickness is decreased gradually from the joint of the leg portion and the coiled portion to the end of the leg portion.

9. The inductor of claim 8, wherein the coiled portion and the leg portion are made of a flat conducting wire.

10. The inductor of claim 8, wherein the first thickness is constant.

11. The inductor of claim 8, wherein the leg portion is flexible or coated with solder.

12. The inductor of claim 8, wherein the extension directions of the leg portions are in parallel or perpendicular to each another.

13. The inductor of claim 8, wherein the leg portion has a thickness ranging from 0.01 mm to 0.40 mm.

14. The inductor of claim 8, wherein the leg portion has a plurality of protrusions formed by a specific process.

15. The inductor of claim 14, wherein any two adjacent protrusions have the same interval.

16. The inductor of claim 14, wherein the specific process is a cutting process or a pressing process.

17. The inductor of claim 8, wherein the second thickness is smaller than the first thickness.

* * * * *